United States Patent [19]

Yoo

[11] Patent Number: 4,646,798

[45] Date of Patent: Mar. 3, 1987

[54] DRINKING WATER DISPENSER WITH CUP SUPPORTING ASSEMBLY

[76] Inventor: Byung Kwon Yoo, 266-3, Nonhyon-Dong, Kangnam-Ku, Seoul, Rep. of Korea

[21] Appl. No.: 756,694

[22] Filed: Jul. 19, 1985

[51] Int. Cl.[4] ..... B65B 3/04

[52] U.S. Cl. ..... 141/377

[58] Field of Search ..... 141/369–381

[56] References Cited

U.S. PATENT DOCUMENTS 1,584,336 5/1926 Walker ..... 141/377

1,703,327 2/1929 Tracy ..... 141/377

*Primary Examiner*—Houston S. Bell, Jr.

*Attorney, Agent, or Firm*—Wenderoth, Lind & Ponack

[57] ABSTRACT

A water pump with which drinking water can be dispensed from a drinking water container. The water pump is equipped with a foldable cup support so that cups can be placed on it, and with a movable cap to seal the mouth of the container, and a dispensing tube which allows the user to easily adjust the dispensing direction of the drinking water.

8 Claims, 4 Drawing Figures

DRINKING WATER DISPENSER WITH CUP SUPPORTING ASSEMBLY

FIELD OF THE INVENTION

This invention pertains to a water pump with which drinking water can be dispensed from a drinking water container. In particular, the water pump is equipped with a movable cap by which the mouth of the container is closed, a dispensing tube which is adjustable in a desired direction, and a support on which cups which receive drinking water dispensed from the container can be conveniently placed.

DESCRIPTION OF THE PRIOR ART

A widely known conventional water pump is equipped with a small type of an electric motor installed at the upper side of a tubular body, a long output axle of the motor extended toward the lower side of the tubular body, a suction impeller installed on the axle and a dispensing tube extending from the upper side of the tubular body.

Such a pump is mainly used in handling oil and each time it is used, the tubular body is put into the inside of the container being used and the contents are pumped outward of the container. Further, there are other types of pumps which are designed so that drinking water can be dispensed with the container upside down but use of a container which is upside down is not the most convenient way of dispensing drinking water from a container.

SUMMARY OF THE INVENTION

An object of the present invention is to provide a water pump, equipped with a cup support for supporting cups placed on it, a movable cap for sealing the mouth of a container and a dispensing tube which allows the user to easily adjust the dispensing direction if desired.

BRIEF DESCRIPTION OF THE DRAWINGS

An example of the water pump of the present invention will be explained with reference to the accompanying drawings, in which.

DESCRIPTION OF THE PREFERRED EMBODIMENTS

Figure 1:
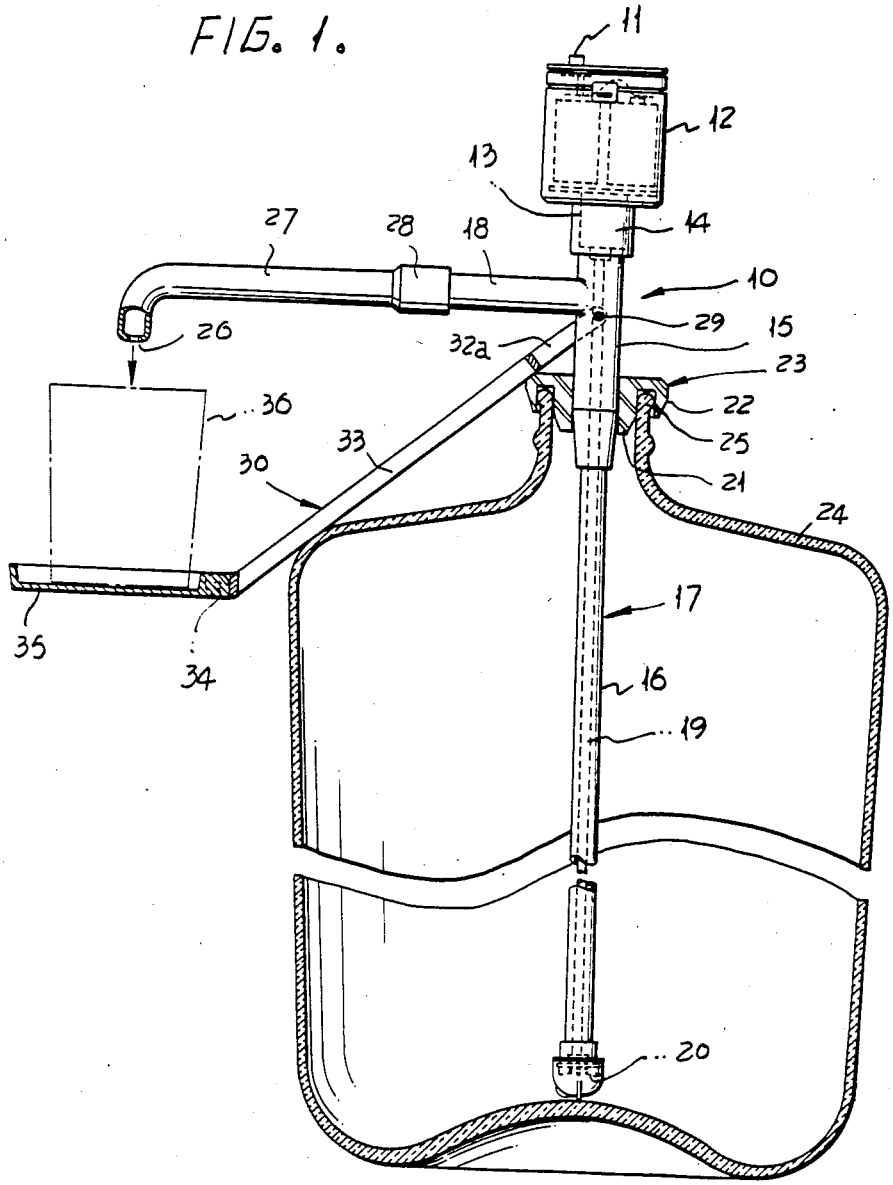
FIG. 1 is a side view, when it is used, of the water pump of this invention.

As shown in FIG. 1, the water pump 10 of the present invention consists of a dry-battery case 12 adapted to receive one or more batteries on which a push-button switch 11 electrically connected to the batteries is installed, a motor housing 14 in which a small motor 13 electrically connected to the push-button switch is installed and which is extended from the bottom of the dry-battery case 12 and a tubular body 17 which is extended from the bottom of the motor housing 14 and comprises a first tube 15 and a second smaller diameter tube 16, both of which are made from plastic material.

A dispensing tube 18 is joined to and extends radially from the first tube 15. A long output axle 19 connected to the motor 13 extends through the first tube 15 and the second tube 16 and a suction impeller 20 is connected to the bottom of the output axle 19.

The pump of the present invention includes support means for mounting the tubular body 17 in a container, the support means being a movable cap 23 which surrounds first tube 15 and has an inner flange 21 and an outer flange 22 which are made of more softer material than that of the tubular body 17. The movable cap 23 closes up or covers the mouth 25 of a container 24 when the tubular body 17 is inserted through the mouth 25 and into the container 24, which may be in the form of a bottle for drinking water.

As shown in FIG. 1, the mouth 25 of the container will be inserted between the inner flange 21 and the outer flange 22 of the movable cap 23.

Accordingly, the movable cap 23 can be used to seal the drinking water container 24 with disregard to the differences between the heights of various drinking water containers.

A curved dispensing tube 27 having an outlet 26 is rotatably connected to the dispensing tube 18.

Figure 3:
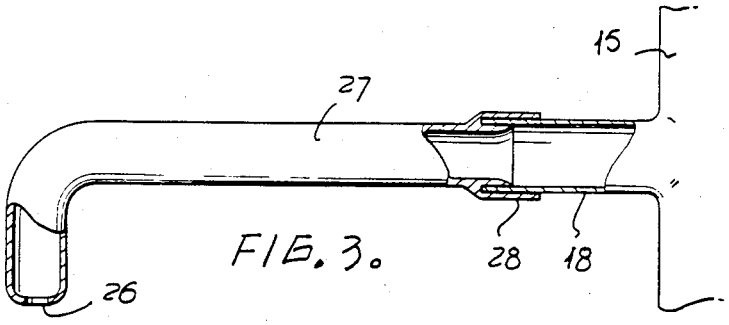
FIG. 3 is a cross sectional view of a dispensing tube.

As shown in the FIG. 3, the curved dispensing tube 27 has a large diametered coupling end 28 rotatably joined to the end of dispensing tube 18 and the direction of a dispensing end 26 of the dispensing tube 27 can be easily adjusted at the users' option since the curved dispensing tube 27 can be rotated about the central axis of the dispensing tube 18.

Figure 2:
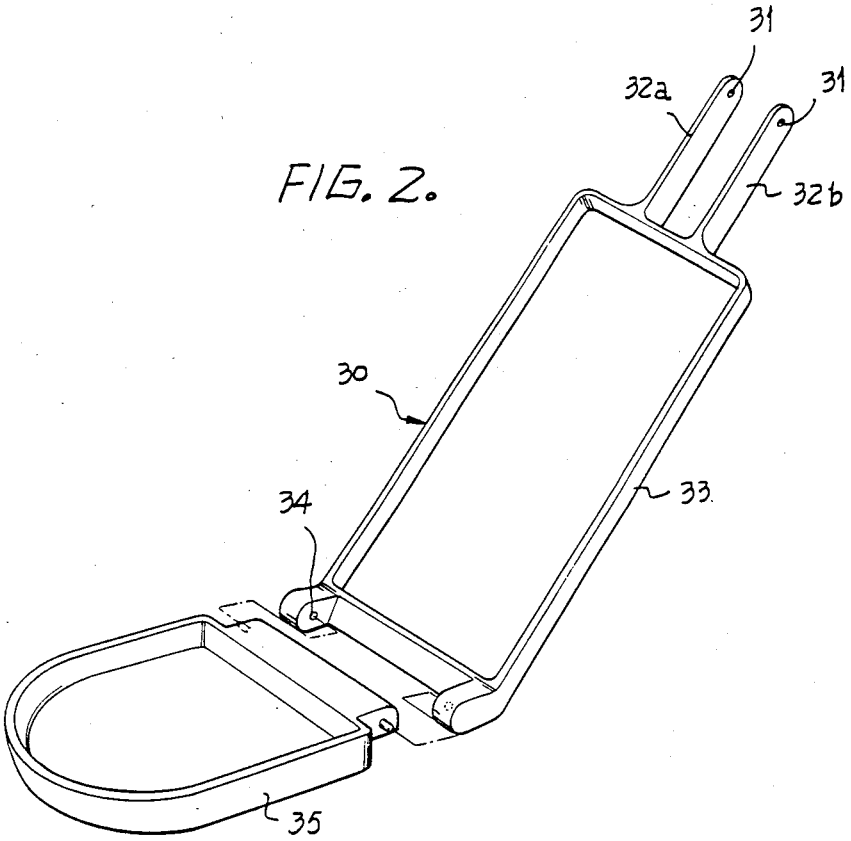
FIG. 2 is a perspective view of a cup support.

Also, on opposite sides of the first tube 15 are projections 29 (only one of which is shown in FIG. 1), and on the projections 29, a cup support assembly 30 is installed, as shown in FIG. 2.

The cup support assembly 30 consists of two arms **32*a* and 32*b* with holes 31 into which each projection 29 is fitted. The cup support assembly 30 includes a pivotable tray 35 supported by a frame 33. The tray 35 can be folded upward but cannot be folded below the horizontal position due to the provision of a hinge 34 installed at the end of the supporting frame 33, the top end of which is connected with the arms 32*a* and 32*b***.

When the water pump is used as shown in FIG. 1, the supporting frame 33 is supported on the shoulder of the container 24, accordingly a cup can be placed on the tray 35.

Figure 4:
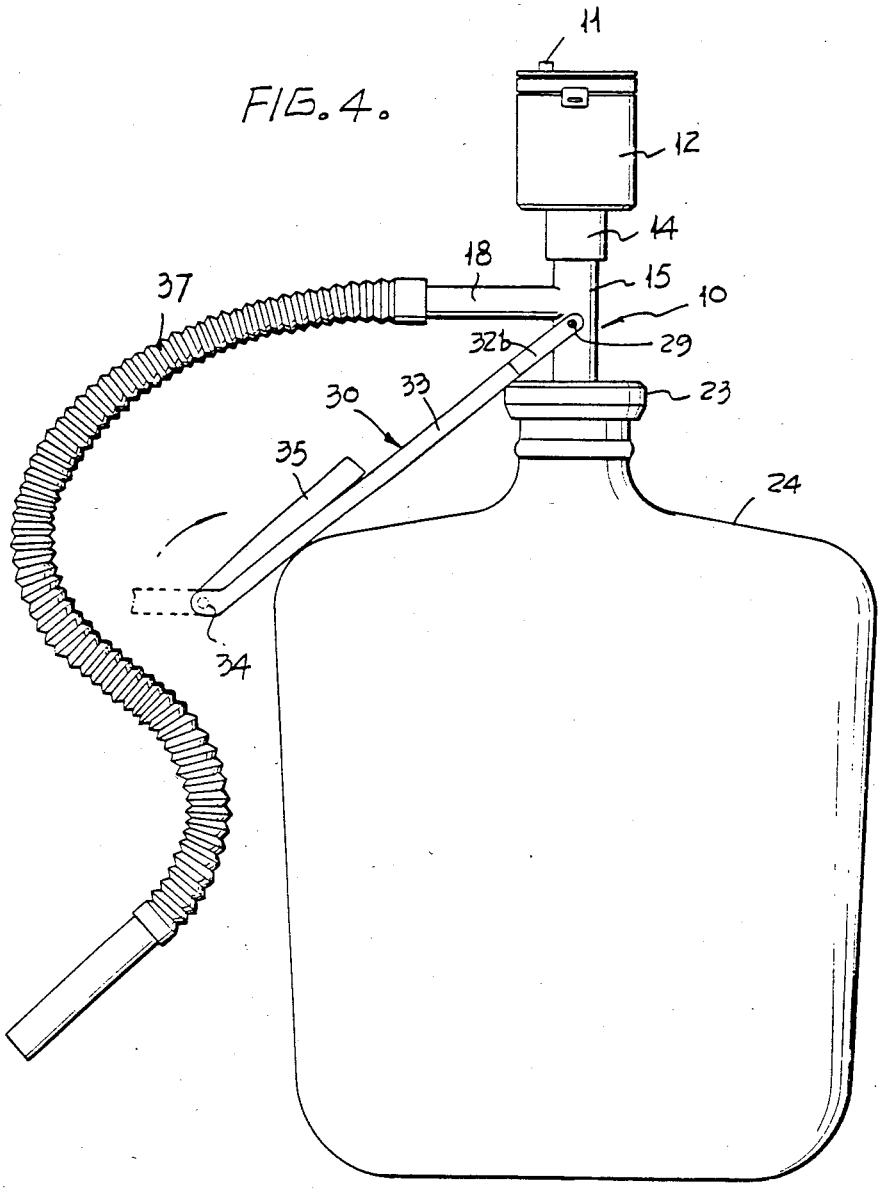
FIG. 4 is a side view of another embodiment of the invention.

The cup support assembly 30 can be either completely separated from the projections 29 of the first tube 15 or the tray 35 can be folded upward substantially parallel with the frame 33 when it is not used, as shown in FIG. 4.

In this invention, the differences between the heights of various containers 24 can be compensated for with the movable cap 23 which allows the tubular body to be adjusted to the height of an individual container. The movable cap 23 also effects reliable sealing of the container 24 and the contents, namely the fresh water, can be easily dispensed through the two dispensing tubes 18 and 27 due to the operation of the impeller 20 which is driven by the motor 13 whenever the press button switch 11 is pushed.

FIG. 4, shows another feature of the invention wherein the pump is connected to a bellows tube 37 instead of the curved dispensing tube 27 which allows the pump of the present invention to be used for other purposes than filling cups supported on the tray 35.

What is claimed is:

1. A dispenser for liquid such as drinking water having a pump and a supporting assembly comprising:

a motor housing;

a motor disposed within said motor housing;

a dry-battery case attached to said motor housing and adapted to receive one or more batteries for supplying electrical power to said motor;

a press button switch disposed on said dry-battery case, said switch being electrically connected to said motor for operation thereof when said switch is pushed;

a plastic tubular body extending from said motor housing, said tubular body including a first tube extending from said motor housing and a second tube extending from said first tube;

means connected to said motor for pumping liquid through said tubular body;

a dispensing tube in fluid communication with and extending radially outward at one end thereof from said first tube;

a pair of projections extending from an outer surface of said first tube;

a cup supporting assembly supported by said projections, said cup supporting assembly including a frame having a pair of arms connected to said projections and a tray pivotally connected to said frame, said tray being pivotable from a folded position in which said tray is substantially parallel with said frame to a cup supporting position in which said tray is maintained in a substantially horizontal position; and support means disposed on said tubular body for mounting the tubular body within a container containing liquid such as drinking water whereby the liquid can be dispensed through said dispensing tube and into a cup supported on said tray by pressing said switch.

2. The dispenser of claim 1, wherein a curved dispensing tube is in fluid communication with and extends from said dispensing tube, said curved dispensing tube being rotatably attached to said dispensing tube.

3. The dispenser of claim 1, wherein a bellows tube is in fluid communication with and extends from said dispensing tube.

4. The dispenser of claim 1, wherein said support means comprises a movable cap slidably mounted on said tubular body, said movable cap having an outer flange adapted to seal the mouth of a container in which said tubular body is inserted.

5. A dispenser for liquid such as drinking water having a pump and a supporting assembly comprising:

a motor housing;

a motor disposed within said motor housing;

a dry-battery case attached to said motor housing and adapted to receive one or more batteries for supplying electrical power to said motor;

a press button switch disposed on said dry-battery case, said switch being electically connected to said motor for operation thereof when said switch is pushed;

a tubular body extending from said motor housing;

an axle extending through said tubular body, said axle being connected to said motor for rotation therewith when said switch is pressed;

a suction impeller mounted on said axle for pumping liquid through said tubular body when said axle is rotated;

a dispensing tube in fluid communication with and extending radially outward at one end thereof from said tubular body;

a pair of projections extending from an outer surface of said tubular body;

a cup supporting assembly supported by said projections, said cup supporting assembly including a frame having a pair of arms connected to said projections and a tray pivotally connected to said frame, said tray being pivotable from a folded position in which said tray is substantially parallel with said frame to a cup supporting position in which said tray is maintained in a substantially horizontal position; and support means disposed on said tubular body for mounting the tubular body within a container containing liquid such as drinking water whereby the liquid can be dispensed through said dispensing tube and into a cup supported on said tray by pressing said switch.

6. The dispenser of claim 5, wherein said support means comprises a movable cap slidably mounted on said tubular body, said movable cap having an outer flange adapted to seal the mouth of a container in which said tubular body is inserted.

7. The dispenser of claim 5, wherein a curved dispensing tube is in fluid communication with and rotatably attached to said dispensing tube.

8. The dispenser of claim 5, wherein a bellows tube is in fluid communication with and extends from said dispensing tube.

* * * * *